US006915759B2

(12) United States Patent
Tanaka

(10) Patent No.: US 6,915,759 B2
(45) Date of Patent: Jul. 12, 2005

(54) PRINTING APPARATUS AND METHOD FOR SPARK PLUG INSULATOR

(75) Inventor: Kazuhiko Tanaka, Kuwana (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/621,498

(22) Filed: Jul. 18, 2003

(65) Prior Publication Data

US 2004/0020380 A1 Feb. 5, 2004

(30) Foreign Application Priority Data

Jul. 31, 2002 (JP) ..... 2002-223756

(51) Int. Cl.[7] ..... B05C 1/08

(52) U.S. Cl. ..... 118/46; 118/211; 118/212; 118/261; 101/38.1; 101/150; 101/154; 101/155; 101/157

(58) Field of Search ..... 118/413, 262, 118/203, 46, 211, 212, 261; 15/256.51, 256.52, 256.53; 101/38.1, 150, 154, 155, 157, 35; 427/428

(56) References Cited

U.S. PATENT DOCUMENTS 4,640,188 A * 2/1987 Cosson et al. ..... 101/39
4,885,992 A * 12/1989 Duce ..... 101/38.1
5,373,783 A * 12/1994 Perry et al. ..... 101/38.1
5,671,678 A * 9/1997 Bolte et al. ..... 101/491
6,111,345 A 8/2000 Shibata et al.

FOREIGN PATENT DOCUMENTS

| | | |
|---|---|---|
| JP | 59-179347 | 10/1984 |
| JP | 64-004275 | 1/1989 |
| JP | 11-111423 | 4/1999 |
| JP | 2002-178654 | 6/2002 |

* cited by examiner

*Primary Examiner*—Laura Edwards
(74) *Attorney, Agent, or Firm*—Nixon & Vanderhye PC

(57) ABSTRACT

An object of the present invention is to disclose an apparatus and method for printing a spark plug, wherein an excellent print quality is obtained and maintained. The printing apparatus comprises: a marking roller for forming an ink film on an intaglio on itself; a transfer roller for transferring the ink film from the intaglio to the spark plug insulator; an ink supply nozzle for supplying the intaglio with the printing ink; and a doctor blade for scratching a surplus ink which does not contribute to form the ink film. the concave depth of the intaglio is made to be between 15 $\mu$m and 20 $\mu$m, both inclusive, thereby optimizing the ink drying.

14 Claims, 18 Drawing Sheets

FIG. 26

| PRINTING PRESSURE (mm) | PRINT QUALITY | FRACTION DEFECTIVE |
|---|---|---|
| -0.3 | UNTRANSFERABLE | 4/4 |
| 0.0 | SOME BLURS | 1/4 |
| 0.1 | NO BLUR | 0/4 |
| 0.3 | NO BLUR | 0/4 |
| 0.5 | NO BLUR | 0/4 |
| 0.8 | NO BLUR | 0/4 |
| 1.0 | NO BLUR | 0/4 |
| 1.2 | NO BLUR | 0/4 |
| 1.8 | SOME BLURS | 1/4 |

FIG. 27

| | BOILING POINT (℃) | 50% REDUCE POINT (℃) | DENSITY |
|---|---|---|---|
| QUICK DRYING THINNER | 155~177 | 162 | 0.871 |
| SLOW DRYING THINNER | 184~205 | 189 | 0.887 |

FIG. 28

| VISCOSITY (POISE) | 5 | 10 | 20 | 30 | 40 | 50 | 60 | 70 | 80 |
|---|---|---|---|---|---|---|---|---|---|
| QUICK DRYING THINNER | △ | ○ | ◎ | ◎ | ◎ | ◎ | ◎ | ◎ | ○ |
| SLOW DRYING THINNER | △ | ○ | ○ | ◎ | ◎ | ◎ | ◎ | ◎ | ○ |

FIG. 29

| INK TEMPERATURE (℃) | UNDILUTED | DILUTED BY 2wt% QUICK DRYING THINNER | DILUTED BY 2wt% SLOW DRYING THINNER |
|---|---|---|---|
| 5 | △ | △ | △ |
| 13 | ○ | ○ | ○ |
| 20 | ○ | ◎ | ◎ |
| 24 | ◎ | ◎ | ◎ |
| 35 | ◎ | ◎ | ◎ |

FIG. 30

| MARKING ROLLER MATERIAL | HEAT TREATMENT | VICKERS HARDNESS | SCRATCHING CAPABILITY |
|---|---|---|---|
| SUJ2 (BEARING STEEL) | QT | 650～700 | ○ |
| SKD11 (DIE STEEL) | QT | 700～750 | ○ |
| SKH4A (HIGH-SPEED STEEL) | QT | 740～800 | ○ |
| SKH57 (HIGH-SPEED STEEL) | QT | 850～ | ○ |

PRINTING APPARATUS AND METHOD FOR SPARK PLUG INSULATOR

BACKGROUND OF THE INVENTION

1. Field of the Invention

The present invention relates to an apparatus and method for printing letters and patterns on an insulator of a spark plug.

2. Description of the Related Art

A conventional printing apparatus 9 as shown in FIG. 25 is used for printing letters and patterns on a surface of a spark plug 5. The letterpress printing apparatus 9 has: an ink roller 91 rotating around a not-shown rotating axis; and other rollers.

Concretely, the printing apparatus 9 comprises: an ink tank 90 for preserving an ink 900; an ink roller 91 for transferring a not-shown ink film through a transferring unit 92 to an ink kneading roller 931; and ink kneading rollers 932 to 936 for adjusting a viscosity and thickness of the ink film.

The letterpress printing apparatus 9 further comprises: a letterpress roller 94 with a letterpress 941 for receiving the ink film from the ink kneading roller 936; and a transferring roller 95 with a transferring surface 950 for receiving the ink film formed on the letterpress 941.

The pattern of letterpress 941 is almost the same as a pattern to be formed on the surface of the spark plug 5. Thus, the ink film transferred from the ink kneading roller 936 is formed on the letterpress 941. Thus, an ink film corresponding to the printing pattern is formed on the letterpress 941. Further, the letterpress roller 94 is made of a rubber.

Further the transferring unit 92 comprises: the ink roller 91; a roller 921 which alternately contacts the ink roller 91 and ink kneading roller 931; and an arm 922 for supporting the roller 921 at a rotating roller 923. In other, words, the roller 921 moves along the arm 922 as a radial arm around the rotating roller 923.

The spark plug insulator 5 is a cylindrical ceramic product with a small radius. Therefore, the outer surface becomes a steep slope. Therefore, the conventional letterpress printing apparatus 9 has a disadvantage that the letterpress 941 is worn away at convex portions, due to contacts with the outer surface of the spark plug insulator. Accordingly, the shape of the letterpress 941 is decaying every printing process and the printing quality becomes degraded, due to the change in the ink film pattern.

SUMMARY OF THE INVENTION

An object of the present invention is to obtain a superior print quality and maintain that printing quality in a printing apparatus and method for printing a surface of an spark plug insulator.

The printing apparatus of the present invention for printing a pattern on a surface of a spark plug insulator comprises:

a marking roller for forming an ink film on an intaglio thereon;

a transfer roller for transferring the ink film which is further transferred to the spark plug insulator in order to print the pattern;

an ink supply nozzle for supplying an ink for the ink film; and a doctor blade for scratching from the marking roller the ink which was surplus in forming the ink film, wherein a concave depth in the intaglio is greater than or equal to 15 $\mu$m and smaller than or equal to 20 $\mu$m.

In short, the printing apparatus of the present invention is an apparatus wherein the ink film is formed on the intaglio on the marking roller and then, the ink film is transferred onto the transfer roller and further onto the spark plug insulator, thereby printing a pattern on the spark plug.

According to the present invention, the intaglio hardly be degraded, because it does not directly contact the spark plug insulator.

Further, according to the present invention, the intaglio does not contact the transfer roller almost at all, because it is constructed by concave portions.

Further, according to the present invention, the intaglio is hardly degraded, because: the ink is prevented from drying; the ink film thickness is maintained constant; and a new ink is introduced into the concave portions of the intaglio every transfer. This is because the concave depth in the intaglio is greater than or equal to 15 $\mu$m and smaller than or equal to 20 $\mu$m.

Thus, an excellent print quality can be obtained and maintained, due to the hardly degrading intaglio.

If the concave depth is smaller than 15 $\mu$m, the ink may possibly be dried, thereby causing blurs and defects in the printed patterns. On the other hand, if the concave depth is greater than 20 $\mu$m, the ink drying is excessively delayed. Therefore, the ink film is not transferred in an complete state, thereby also causing blurs and defects in the printed patterns.

The printing method of the present invention is a method employing the above-mentioned printing apparatus.

BRIEF EXPLANATION OF THE DRAWINGS

FIG. 26 is a table showing a relation between the print quality and printing pressure (expressed by a compression of the transfer roller) of minus 0.3 mm to plus 1.8 mm.

FIG. 27 is a table of thinners for diluting the ink including inorganic pigment, resin, glass flit and solvent.

FIG. 28 is a table showing a relation between the print quality and ink viscosity.

FIG. 29 is a table showing a relation between the print quality and ink temperature.

FIG. 30 is a table showing a relation between the print quality and marking roller hardness.

PREFERRED EMBODIMENT OF THE INVENTION

Figure 1:
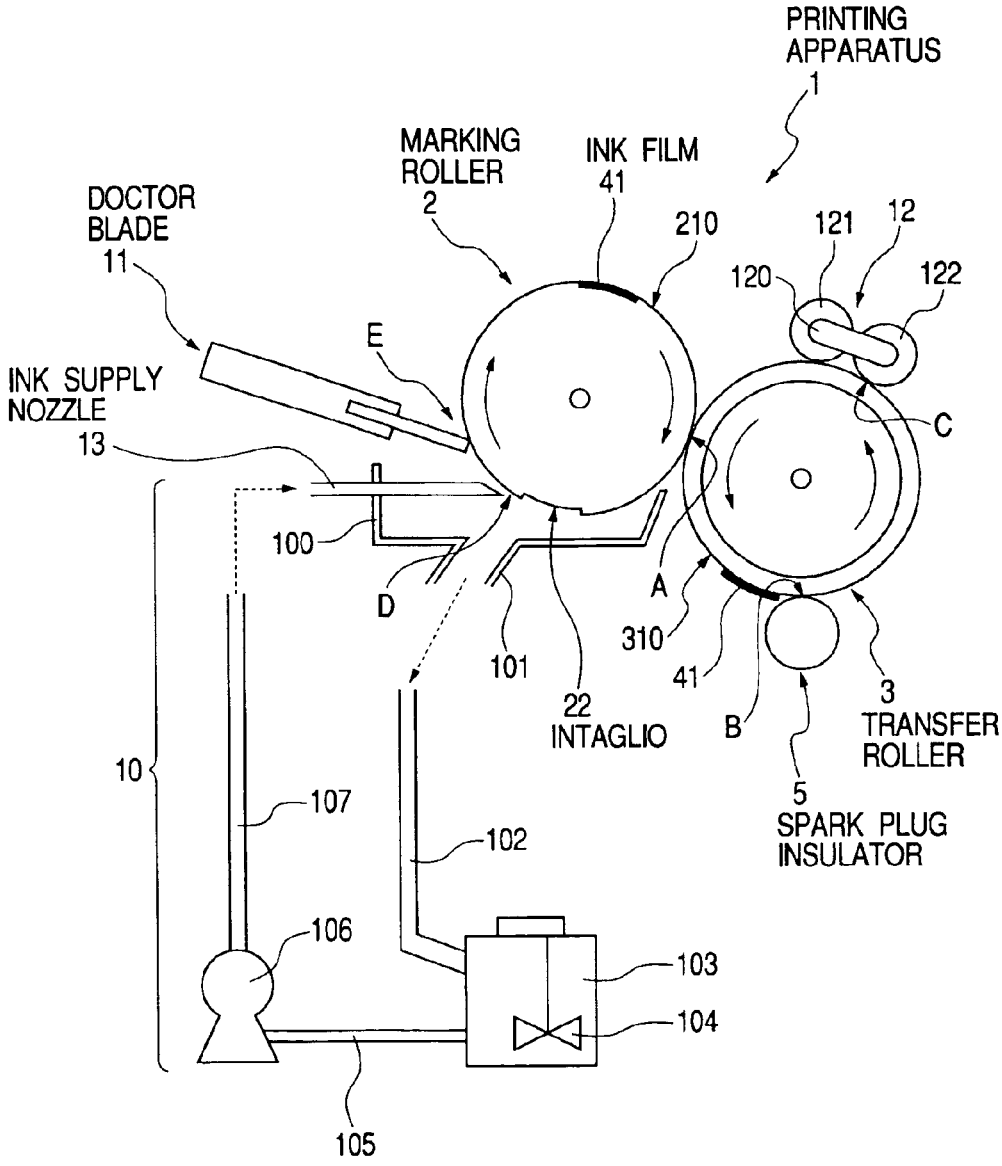
FIG. 1 shows a concept of the printing apparatus of Example 1 of the present invention.

The present invention includes eleven Features stated below.

In accordance with Feature 1, the printing apparatus of the present invention comprises at least two rollers, i.e., a marking roller and transfer roller. They are rotatably supported by roation axes.

A printing ink is supplied by an ink supply nozzle at a place where the marking roller approaches most the ink supply nozzle. Thus, an ink film is formed on an intaglio on the marking roller. Then, a surplus ink which did not contribute to form the ink film is scratched by a doctor blade disposed at a down stream side along the rotation direction of the marking roller.

Then, at a place further down stream side along the rotation direction of the marking roller, the transfer roller contacts the marking roller, whereby the ink film on the intaglio is transferred to the transfer roller.

When the printing ink is supplied onto the intaglio on the marking roller, it is preferable to recover an ink which was not held on the intaglio and was dropped off. Therefore, an ink pan is preferably disposed below the ink supply nozzle and marking roller.

It is further preferable to avoid a wastage of the printing ink, by providing a stirring circulation mechanism in order to prevent the recovered ink from precipitating and to return it back again to the ink supply nozzle.

Further, it is preferable to provide a cleaning roller in order to remove ink residues and grouts on the transfer roller after transferring the ink from the transfer roller to the spark plug.

With the cleaning roller, the transfer roller is prevented from becoming stained, so that stains that would degrade the print quality on the spark plug insulator are not transferred to the spark plug.

Further, it is preferable to construct the cleaning roller in such a manner that it is easily changed after a prescribed time interval, because the cleaning roller becomes dirty after using a long period of time.

The marking roller and transfer roller may be arranged along the vertical or horizontal direction.

In accordance with Feature 2, the marking roller may preferably be made of metal, while the transfer roller be made of resin, rubber, or resin & rubber, whereby the ink film is transferred under a suitable printing pressure due to an elasticity of the transfer roller.

Alternatively, only the intaglio may be made of metal. Further, only a transferring surface may be made of resin or rubber. Further, the core of the transfer roller may be made of resin, while its surface may be made of rubber.

The material for the marking roller may be a die steel such as SKD11, or a high-speed steel such as SKH. Further, the material for the transfer roller may be, e.g., a lubricant silicone rubber.

In accordance with Feature 3, it is preferable that the marking roller and transfer roller contact with each other at substantially constant rotation speed and printing pressure.

If the rotation speed or printing pressure is changed in time, the printed pattern may possibly be shifted or stained. Therefore, a gear backlash and the like should be eliminated.

Here, the printing pressure is a contact pressure between the marking roller and transfer roller, measured by a compression in millimeter of the transfer roller, while the rotation speed is a circumferential speed in meter/minute, calculated by radius (of the marking roller or transfer roller) in mm multiplied by 0.00314 multiplied by rotation number in rpm.

In accordance with Feature 4, it is preferable that said doctor blade: is disposed at an upper side of said marking roller; is movable along the tangential and normal directions of the surface of said marking roller; and is pressed against said marking roller along a direction normal to the longitudinal direction of said doctor blade.

Therefore, the surplus ink is sufficiently scratched by a force of vector summation of a rotation force FR, pressing force FG along the longitudinal direction of the doctor blade and another pressing force FT along a direction normal to the longitudinal direction of the doctor blade. Accordingly, the surplus ink can not attach the transfer roller, thereby obtaining an excellent print quality.

The above mentioned pressing force FT is obtained by disposing the doctor blade at uppper side of the marking roller.

In order to obtain FT, a pressing member such as a ball plunger may be employed for pressing down a scratching edge of the doctor blade.

In accordance with Feature 5, it is preferable that said doctor blade is disposed at a lower side of said marking roller and is movable along the tangential and normal directions of the surface of said marking roller.

Therefore, even when there is caused in the marking roller a distortion or eccentricity, the doctor blade well follws the marking roller motion, thereby sufficiently scratching the surplus ink, preventing the surplus ink from attaching on the transfer roller and obtaining an excellent print quality.

In accordance with Feature 6, it is preferable that said doctor blade is softer than said marking roller.

Therefore, it is avoided that the marking roller is damaged by the doctor blade.

In accordance with Feature 7, said printing pressure expressed by a compression of said transfer roller is greater than or equal to 0.3 mm and smaller than or equal to 0.8 mm.

Therefore, the elasticity of the transfer roller is controlled, thereby completely transferring the ink film.

If the printing pressure is smaller than 0.3 mm, the ink film from the marking roller may not be transferred. On the other hand, if the printing pressure is greater than 0.8 mm, the print quality may possibly be degraded due to blurs and line width reductions.

Although essentially the printing pressure should be expressed in a physical pressure unit, it is expressed in the present invention by a compression of the transfer roller in millimeter. This is rather advantageous, because the printing pressure is easily controlled by a movement of a mechanism such as a gear mechanism.

In accordance with Feature 8, it is preferable that the ink temperature is higher than or equal to 20° C. and lower than or equal to 35° C.

If the ink temperature is lower than 20° C., the ink viscosity becomes too high, and it becomes difficult or impossible to transfer the ink. Therefore, the ink temperature is preferably higher than or equal to 20° C. Further, the ink temperature is preferably lower than or equal to 35° C., because an evaporation of the thinner for diluting the ink should be prevented. If the ink temperature is higher than 35° C., the ink may be rapidly dried or solidified on the transfer roller. Accordingly, the ink is not put on the spark plug insulator, thereby causing defects and blurs in the printed pattern or printing nothing.

In accordance with Feature 9, the surface of said transfer roller is stepped in accordance with the insulator surface of the spark plug.

Therefore, the ink film is transferred from the transfer roller of which outer shape corresponds to that of the spark plug insulator. Thus, an excellent print quality is obtained in spite of the step and unevenness of the spark plug.

In accordance with Feature 10, it is preferable that the surface of said marking roller is hardened. Further, in accordance with Feature 11, it is preferable that the surface of said marking roller is coated by TiN.

Therefore, it is prevented that the intaglio on the marking roller is abrased damaged. Thus, an accuracy and preciseness of the intaglio are mantained, thereby obtaining and maintaining the print quality.

Particularly, TiN protects strongly the transfer roller surface. TiN coating can be executed by physical or chemical vapor deposition (PVD or CVD).

Next, the working examples of the present invention are explained, referring to the drawings.

EXAMPLE 1

Figure 2:
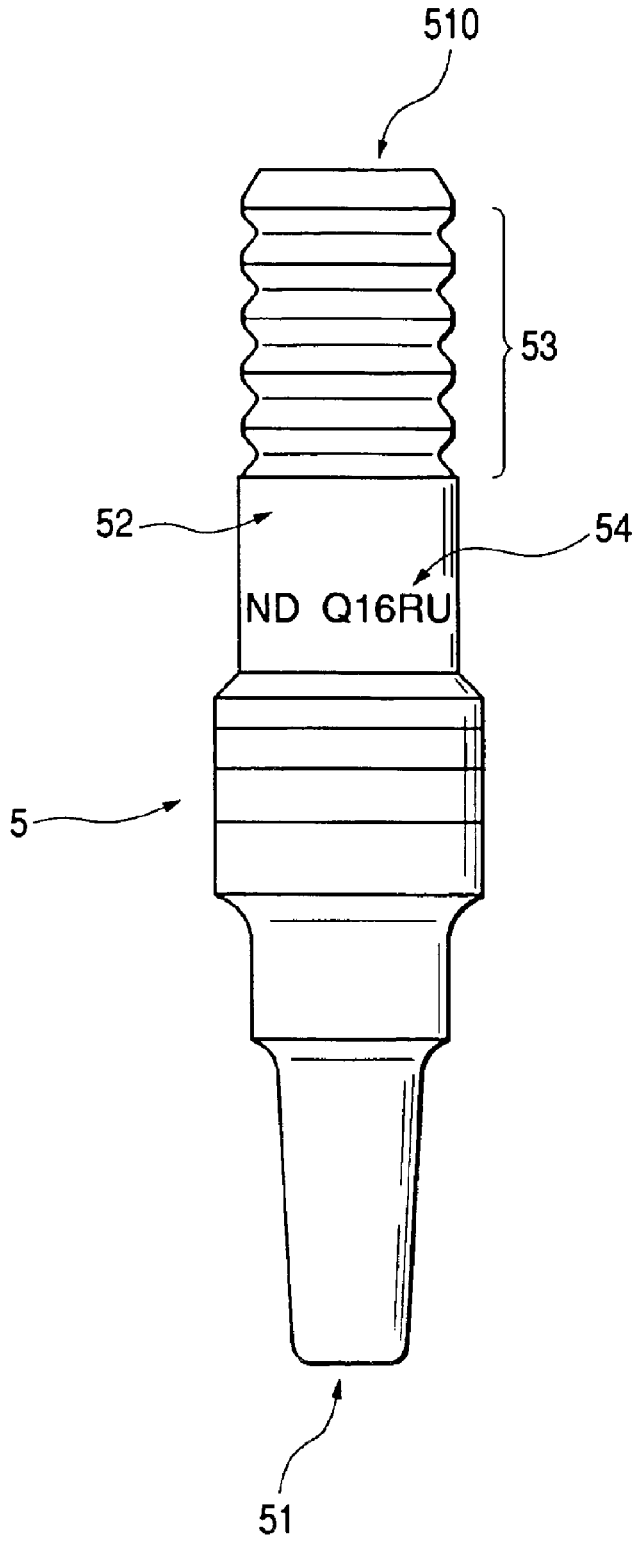
FIG. 2 shows the spark plug of Example 1.
Figure 3:
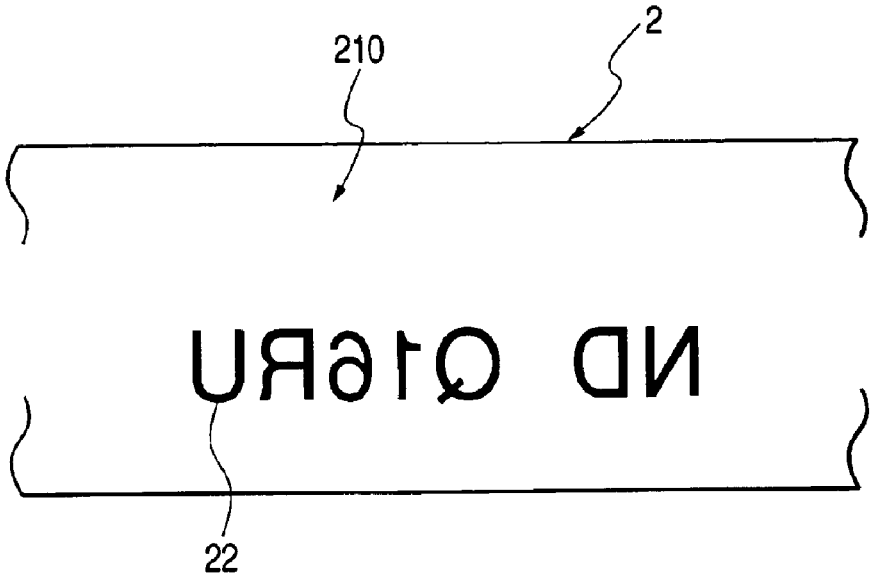
FIG. 3 shows the intaglio on the marking roller of Example 1.

A printing apparatus 1 of Example 1 of the present invention is explained, referring to FIGS. 1 and 2. The printing apparatus 1 prints a pattern 54 on the spark plug insulator 5.

The printing apparatus 1 comprises: a cylindrical marking roller 2 with an intaglio 22 for forming an ink film 41 by receiving an ink in a surface 210; and a cylindrical transfer roller 3 with a transferring surface 310 for forming a pattern 54 to be printed on the surface of the spark insulator 5.

The printing apparatus 1 further comprises: an ink supply nozzle 13 for supplying the intaglio 22 on the marking roller 2 with the ink; a doctor blade 11 for scratching off a surplus ink which did not contribute to form the ink film 41 on the marking roller 2. The depth of the concave portions of the printing intaglio 22 is between 15 $\mu$m and 20 $\mu$m, both inclusive.

As shown in FIG. 1, the printing apparatus of Example 1 comprises: a marking roller 2; a transfer roller 3; ink supply nozzle 13; a doctor blade 11; cleaning roller 12; and stirring circulation mechanism 10.

As shown in FIG. 2, a pattern 54 is printed on the side surface of a spark plug insulator 5.

Here, the spark plug insulator 5 is a bottomed cylinder of. e.g., alumina ceramics, wherein the side surface is stepped and the diameter of the lead tip 51 is different from that of the base tip 510. There is a not-stepped extension 52 near the central portion, while there is a regularly stepped portion 53 between the base tip 510 and the central portion. There is the printed pattern 54 on the extension 52.

In the printing apparatus 1, the cylindrical marking roller 2 rotatably supported by a rotation axis has an intaglio 22 for holding an ink film 41 on the surface 210. The intaglio 22 has concave portions of mirror images of the printed pattern.

The depth of the concave portion is between 15 to 20 $\mu$m, both inclusive, where the depth is defined by a distance measured along the radial direction of the marking roller 2 from an averaged surface to an averaged bottom.

For example, the marking roller 2 is made of a die steel SKD11 of, e.g., hardness (HRC) 60 to 62, diameter 75 mm and width 20 mm.

The transfer roller 3 is rotatably supported by a rotation axis and the outer surface is a transferring surface 310.

The ink film 41 is transferred at the transferring surface 310 from the marking roller 2, thereby forming the the pattern 54 on the spark plug insulator 5, by transferring the ink film 41 from the transferring surface 310 to the extension 52 of the spark plug insulator 5.

The transferring surface 310 is a smooth surface almost without any convex and concave. For example, the transfer roller 3 may be made of a silicone rubber of hardness 50 degrees, diameter 75 and width 10 mm.

Further, the stirring circulation mechanism 10 is a system for reuse a surplus ink which was splayed from the ink supply nozzle, but did not contribute to form the ink film on the intaglio 22 of the marking roller 2.

In the stirring circulation mechanism 10, there is provided below the marking roller 2 an ink pan 100 of which bottom is provided with an exhaust route 101 toward a stirring tank 103 through a transfer pipe 102. The surplus ink which was not consumed for forming the ink film is recovered through the exhaust route 101. The recovered ink is collected into the stirring tank 103 which stirs the recovered ink by a stirring wing 104, thereby preventing the ink from precipitating and controlling an ink viscosity.

The stirring tank 104 is connected through a transfer pipe 105 with a pump 106 which is further connected through another transfer pipe 107 with the ink supply nozzle 13.

Thus, the ink stirred in the stirring tank 104 is again sent by the pump 106 to the ink supply nozzle 13 for splaying the ink on the marking rolller 2.

The doctor blade 11 contacts the marking roller 2, thereby scratching the surplus ink.

The doctor blade 11 comprises: a scratching edge for scratching the ink; and a supporting member of supporting the scratching edge, as explained later in Example 2, referring to FIGS. 4 to 6.

The doctor blade 11 may be disposed at the upper side of the marking roller 2 as described in Example 2, although it is disposed at the lower side of the marking roller 2 as described in Examples 1 and 3.

Further, the cleaning roller 12 in contact with the transfer roller 3 removes a residual ink film and ink grouts on the transfer surface 310 after transferring the ink from the transfer surface 310 to the spark plug insulator 5.

The cleaning roller 12 includes two rollers 121 and 122 of which rotation axes (not-shown) are coupled by a belt 120.

The cleaning roller 12 should be exchanged at a prescribed time interval, due to accumulated adhesion of the ink grouts. Preferably, the cleaning roller 12 is easily exchanged and, for example, a paper tape may be wound on the roller surface, thereby dumping the paper tape together with the ink grouts.

The marking roller 2 rotates clockwise in contact with the transfer roller 3 at a position A as shown in FIG. 1. Further, the transfer surface contacts the spark plug insulator 5 at a position B, a down stream side along the anti-clockwise rotation direction of the transfer roller 3 which further contacts the cleaning roller 12 at a position C, a downstream from B, along the rotation direction of the transfer roller 3. The ink film 41 is transferred to the spark plug insulator 5 at the contact position B.

The ink supply nozzle 13 is disposed at a position D, a down stream from A, along the clockwise rotation direction of the marking roller 2. Further, the doctor blade 11 is disposed at a position E, a down stream from D, along the rotation direction of the marking roller 2.

The marking roller 2 is designed to contact the transfer roller 3 in such a manner that they contact with each other at the same position A under a pressure and rotation speed which are substantially constant in time.

For example, the rotation speed of the marking roller 2 and transfer roller 3 may be 12 rpm or 47.1 mm/sec.

Further, the ink may contain, for example, 45 to 65% by weight of inorganic pigment, 20 to 40% by weight of alkyd resin, 2 to 5% by weight of glass flit (melting point, e.g., 350° C.) and 7 to 13% by weight of aromatic hydrocarbon solvent.

The above-mentioned ink may become of density 1.5 to 1.9, ignition temperature 480° C. and boiling point 140° C. That ink is diluted to be 20 to 40 poise in viscosity and used for printing at 20 to 35° C.

The diluted ink is splayed from the ink supply nozzle 13 to the marking roller 2, when the intaglio 22 reaches the ink supply nozzle. Then, the splayed ink is filled into the concave portions of the intaglio 22, thereby forming the ink film, while the surplus ink falls down in the ink pan 100. The surplus ink in the ink pan 100 is again directed to the ink supply nozzle in the stirring circulation mechanism 10.

Although the ink film 41 is formed by the splaying process, there are also caused smudges on the marking roller 2. However, the smudges are scratched and removed by the doctor blade 11 at the position E.

Then, the intaglio 22 contacts the transfer roller 3 at the position A, thereby transferring the ink film 41 to the transfer roller 3 and emptying the concave portions of the intaglio 22.

When the ink film 41 reaches the position B, it is transferred on the spark plug insulator 5, thereby forming the printed pattern 54 and then introducing a new non-printed spark plug insulator 5.

The residual smudges on the transfer surface 310 are cleaned by the cleaning roller 12. Accordingly, the transfer surface 310 is always clean at the contact point A.

According to the printing apparatus as explained above, the intaglio 22 becomes hardly degraded, because it does not directly contact the spark plug insulator 5.

Further, according to the printing apparatus 1, the intaglio 22 does not almost at all contact the transfer roller 3, because it is constructed by the concave portions. As a result, there is hardly caused any degradation in the print quality such as blur, defect, or blot.

Thus, according to the printing apparatus of Example 1, the excellent print quality on the spark plug surface is obtained and maintained.

EXAMPLE 2

Example 2 relates to another printing apparatus wherein the doctor blade 11 is positioned at an upper side of the marking roller 2.

Figure 4:
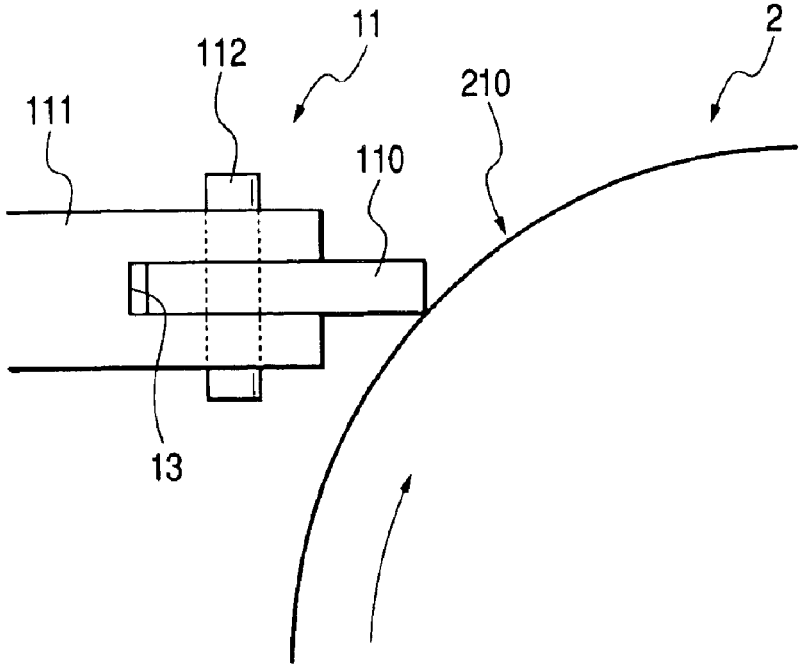
FIG. 4 shows the contact between the doctor blade and marking roller of Example 2.
Figure 5:
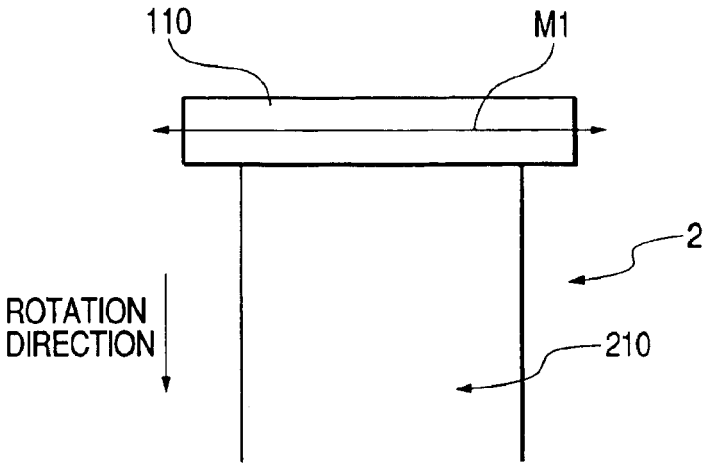
FIG. 5 is a top view showing the contact as shown in FIG. 4.
Figure 6:
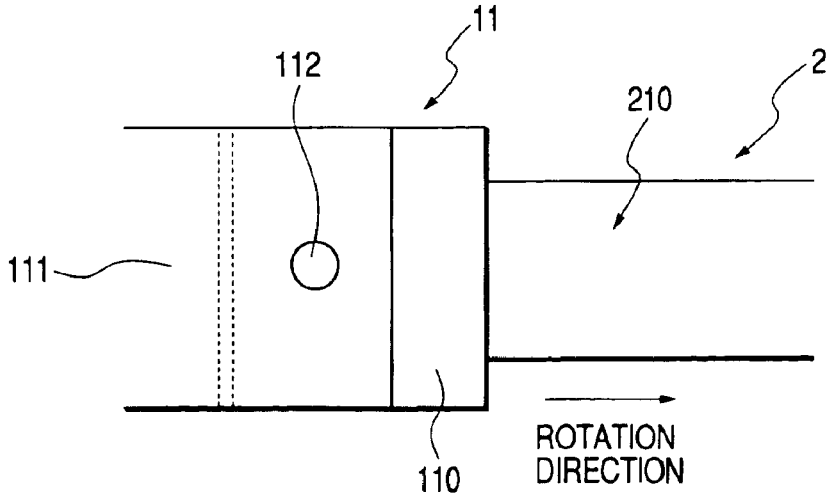
FIG. 6 is another top view showing the contact as shown in FIG. 4.

The doctor blade 11 as shown in FIGS. 4 to 6 comprises: a scratching edge 110 for scratching the ink; and a supporting member 111 for supporting the scratching edge 110. As shown in FIG. 4, the root of the scratching edge 110 is inserted into a notch 113 of the supporting member 111. Further, the scratching edge 110 is fixed at the supporting member 11 by a pin 112 which passes through the supporting member 111.

FIGS. 5 and 6 show the contact between the scratching edge 110 and the marking roller 2.

The lower edge of the scratching edge 110 contacts the marking edge 2, thereby scratching the surplus ink. As shown in FIG. 5, the movable range of the scratching edge 110 is designated by an arrow M1, wherein the scratching edge 110 is wider than the marking roller 2.

Figure 7:
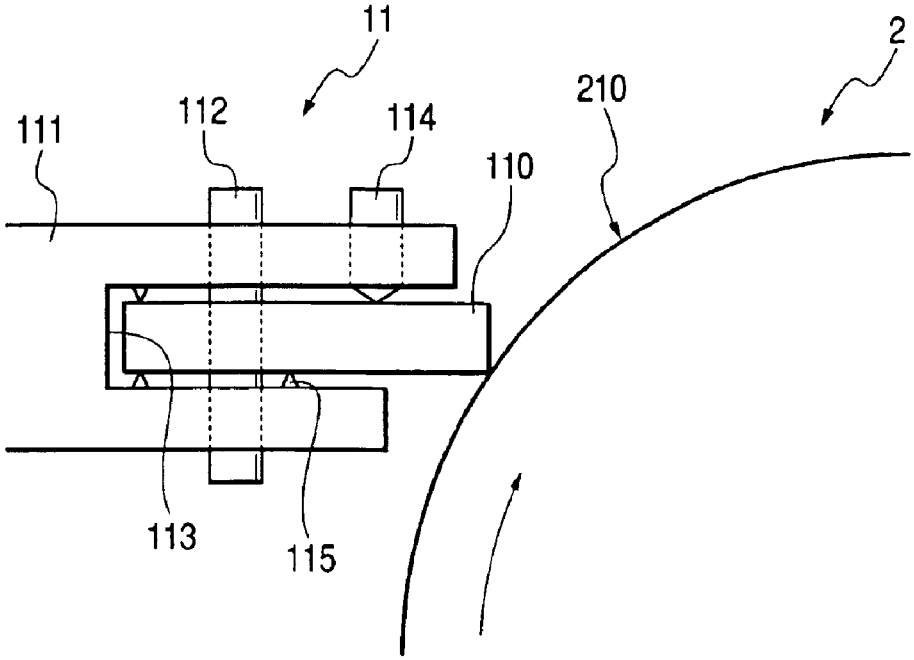
FIG. 7 shows the contact between the marking roller and another doctor blade with ball plunger of Example 2 for pressing the scratching edge.
Figure 8:
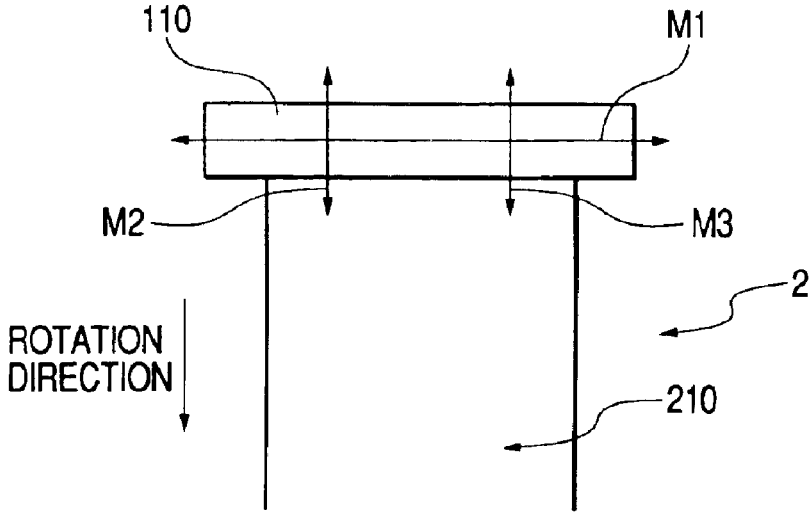
FIG. 8 is a top view showing the contact as shown in FIG. 7.

Further, FIGS. 7 and 8 shows another doctor blade 11 different from that as shown in FIGS. 4 to 6. The doctor blade 11 as shown in FIGS. 7 and 8 comprises: a ball plunger 114 for pressing from the upper side the scratching edge 110; a supporting projection 115 for supporting the scratching edge 110 in the notch 113. Two ball plungers 114 along the width direction of the scratching edge 110. Each of the plungers 114 presses down the scratching edge 110 at about, e.g., 3 kg/f sufficiently great enough to prevent the scratching edge 110 from rebounding.

Similar to FIG. 5, the movable direction of the scratching edge 110 is shown by an arrow M1 perpendicular to the rotation direction of the marking roller 2. Further, the scratching edge can follow the swelling motions of the marking roller 2 as shown by arrows M2 and M3.

The printing apparatus 1 as shown in FIG. 1 which is provided with the doctor blade 11 as shown in FIGS. 4 to 8 produces printed pattern of superior quality with little or without any dust, stain, or blur.

The doctor blade 11 as shown in FIGS. 7 and 8 presses the marking roller 3 at a uniform force by the ball plunger 114. Therefore, its scratching edge 110 swells little. Accordingly, the doctor blade 11 as shown in FIGS. 7 and 8 scratches the ink more efficiently than that as shown in FIGS. 4 to 6.

Further, the scratching life of the scrathing blade 11 as shown in FIGS. 7 and 8 was found longer than that as shown in FIGS. 4 to 6.

Due to the long-life doctor blade 11, a machine adjusting time is reduced and inferior printing ratio is reduced.

Figure 9:
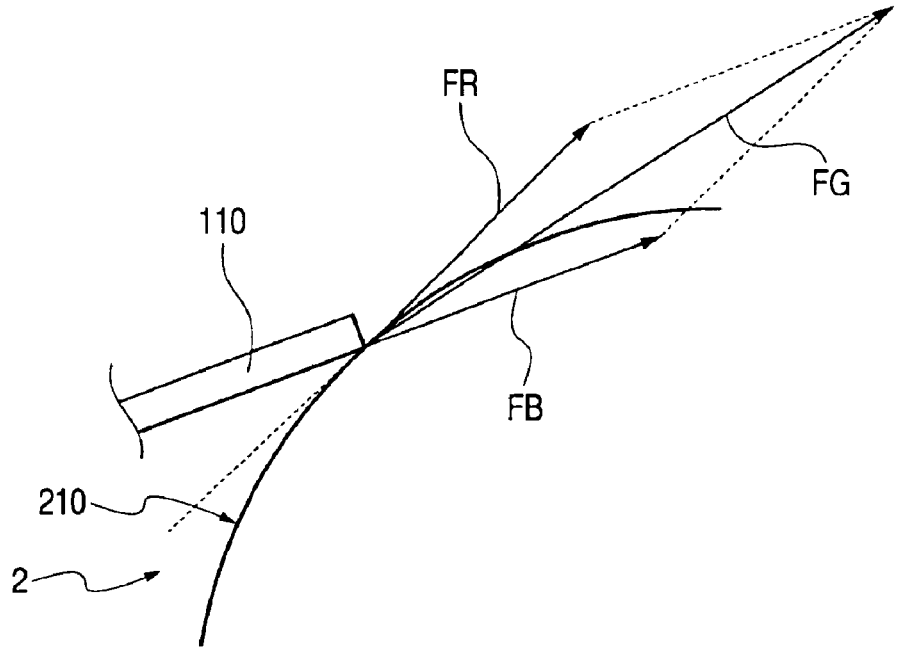
FIG. 9 shows a vector summation of forces acting at the contact point in FIGS. 4 to 6.

Here, the force FB by the doctor blade 11 as shown in FIGS. 4 to 6 is shown in FIG. 9, wherein FG is a vector summation of FR and FB, where FR is a rotational force by the marking roller 2 along the tangential direction at the contact position E, and FB is a force by the scratching edge 110.

Figure 10:
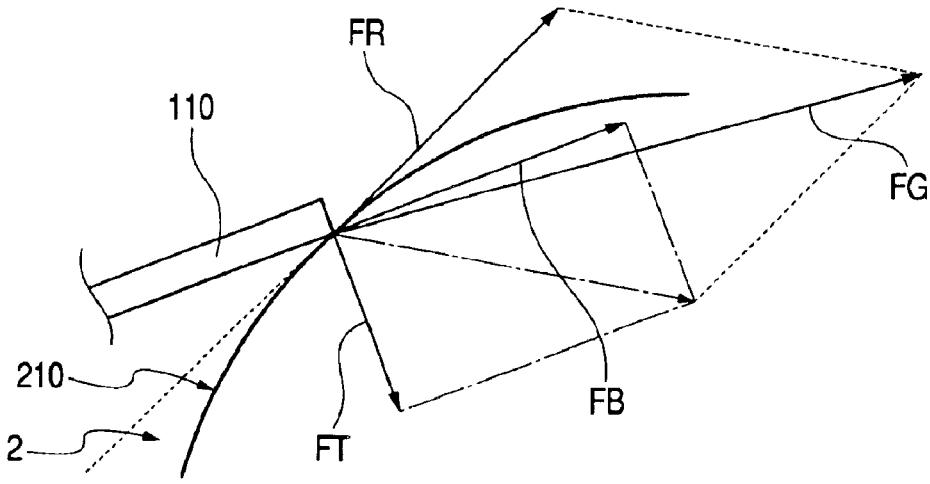
FIG. 10 shows a vector summation of forces acting at the contact point in FIGS. 7 and 8.

Further, the force FG by the doctor blade 11 as shown in FIGS. 7 and 8 is shown in FIG. 10, wherein FG is a vector summation of FR, FB and FT by the ball plunger 114.

FG as shown in FIG. 10 is directed along the inside direction of the marking roller 2 more inner than FG as shown in FIG. 9. Accordingly, the doctor blade 11 with the ball plunger 114 as shown in FIGS. 7 and 8 can follow the motion of the marking roller 2 better than that as shown in FIGS. 4 to 6, thereby improving the scratching efficiency of the doctor blade 11 as shown in FIGS. 7 and 8.

EXAMPLE 3

Example 3 relates to still another printing apparatus wherein the doctor blade 11 is positioned at an lower side of the marking roller.

Figure 11A:
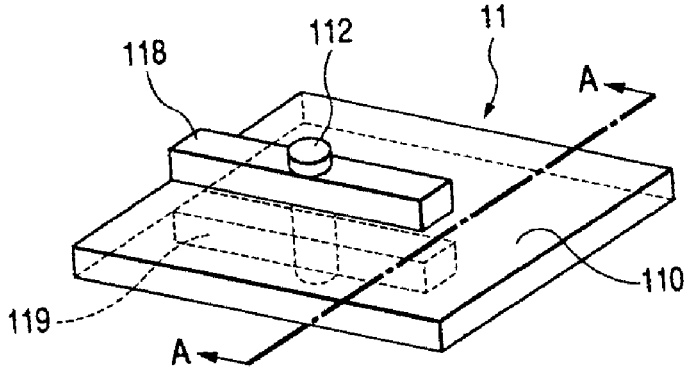
FIGS. 11A, 11B and 11C show the contact between the marking roller and doctor blade of Example 3.

The doctor blade 11 as shown in FIGS. 11A, 11B & 11C and FIG. 12 comprises: a scratching edge 110 for scratching the ink; and supporting members 118 and 119 for supporting the scratching edge 110. As shown in FIG. 11A, the scratching edge 110 is held from its upper and lower sides between the supporting members 118 and 119 and is further fixed by a pin 112 passing through the supporting members 118 and 119.

Figure 11B:
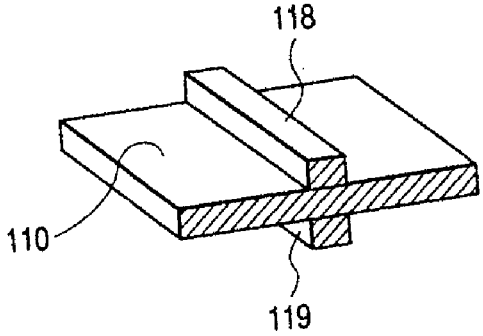
Figure 11C:
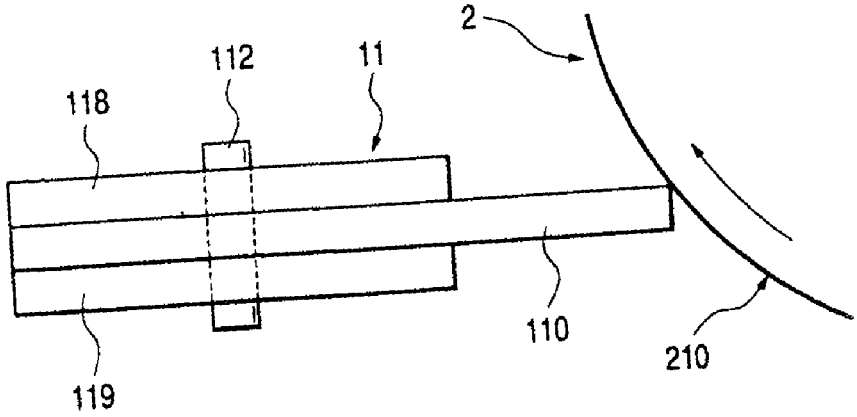
Figure 12:
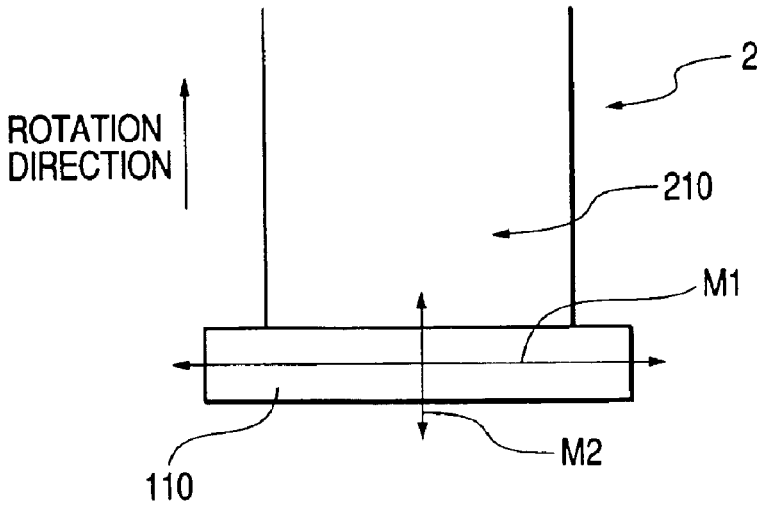
FIG. 12 is a top view showing the contact as shown in FIG. 11C.

FIG. 11B is a perspective view along A—A, wherein the doctor blade 11 is cross-shaped. Further, FIG. 11C and FIG. 12 show the contact between the scratching edge 110 and the marking roller.

The upper edge of the scratching edge 110 contacts the marking edge 2, thereby scratching the surplus ink. As shown in FIG. 12, the movable range of the scratching edge 110 is shown by an arrow M1, wherein the scratching edge 110 is wider than the marking roller 2. The scratching edge 110 is made movable along a direction M2 parallel to the rotation direction of the marking roller 2.

Figure 13:
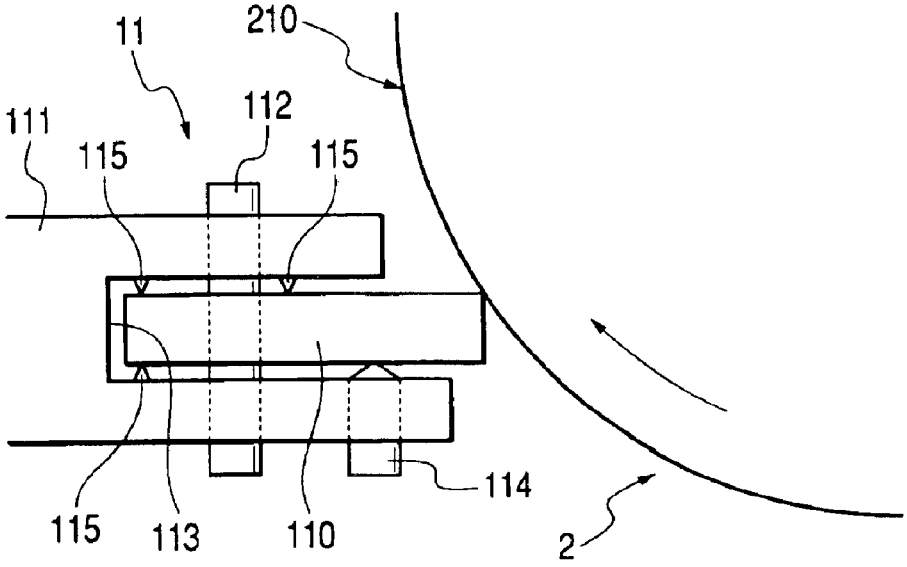
FIG. 13 shows the contact between the marking roller and another doctor blade with ball plunger of Example 3 for pressing the scratching edge.
Figure 14:
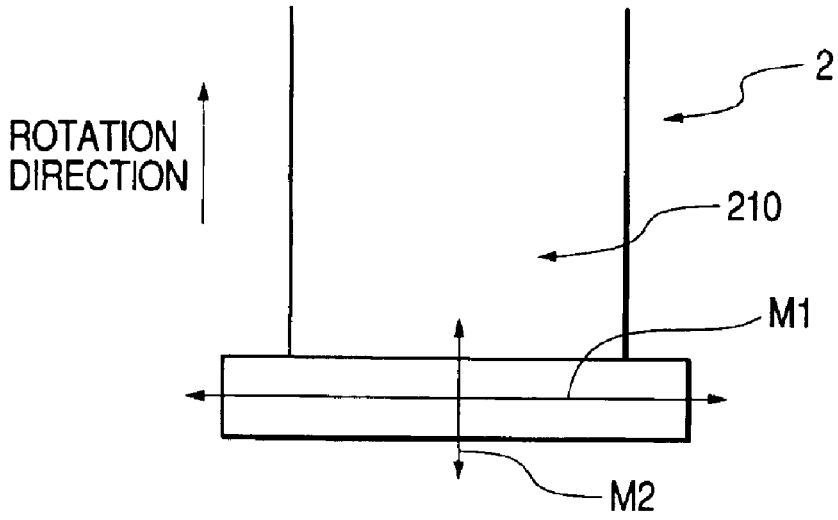
FIG. 14 is a top view showing the contact as shown in FIG. 13.

Further, FIGS. 13 and 14 shows still another doctor blade 11 different from that as shown in FIGS. 11A, 11B & 11C and FIG. 12. The doctor blade 11 as shown in FIGS. 13 and 14 is similar to that as shown in FIGS. 7 and 8. However, As shown in FIGS. 13 and 14, the doctor blade 11 is positioned at a lower side of the marking roller 2, thereby scratching the surplus ink on the marking roller 2 by the upper edge of the scratching edge 110.

The above-explained doctor blades 11 well follow the swelling motion of the marking roller 2, thereby well scratching the surplus ink on the marking roller 2.

Due to the long-life scratching capability of the above-explained doctor blades 11, a machine adjusting time is reduced and inferior printing ratio is reduced.

EXAMPLE 4

In the present Example 4, various intaglios 22 (provided with a mesh over the whole intaglio 22; provide with a mesh over one third area of the intaglio 22; and without any mesh over the intaglio 22) on the same printing apparatus as shown in Example 1 are compared. The concave portions of intaglio 22 provided with the mesh construct a half tone plate.

According to the one third area mesh, the doctor blade 11 did not jump. Here, the jump of the doctor blade 11 is a jump at a step at a border of the concave portions of the intaglio 22 and the surface 210. The jump is caused by a line contact necessary for scratching the surplus ink. When the jumps are caused, the ink is transferred in a multiple split lines.

According to the one third mesh, there were not caused the jump, thereby obtaining printed patters of very good quality.

According to the non-meshed intaglio 22, several jumps were observed, when narrow spaced patterns such as small characters, narrow areas, or fine marks were printed. However, the printing quality is still good.

According to the whole area meshed intaglio 22, the printed patterns were often unclear, when narrow spaced patterns such as small characters, narrow areas, or fine marks were printed. However, the printing quality is still good.

Therefore, the print quality is improved by providing the intaglio 22 with the mesh, when the patterns to be printed are large character or large area marks.

EXAMPLE 5

The tip shapes of the ink supply nozzle 13 are explained.

Figure 15:
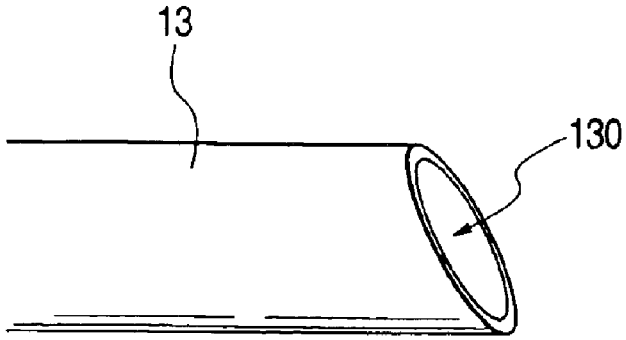
FIG. 15 is a conceptual perspective view of the ink supply nozzle of Example 5.
Figure 16:
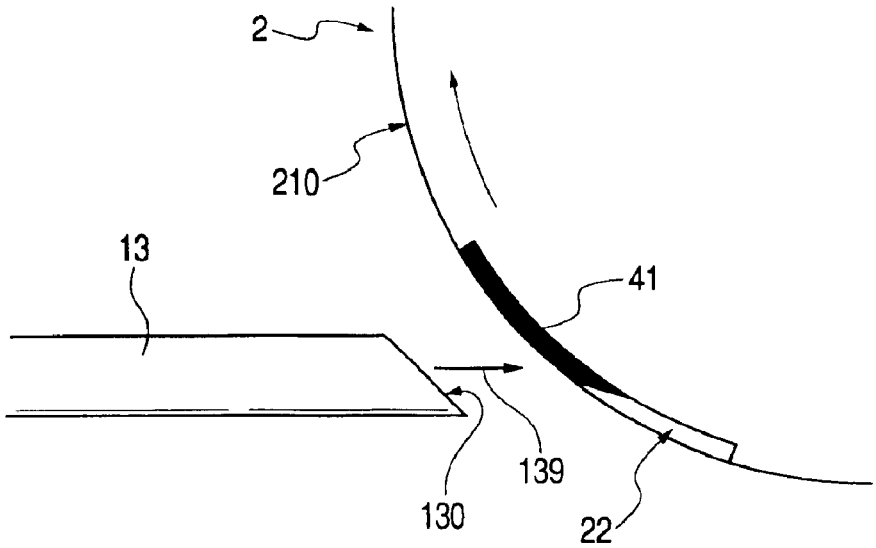
FIG. 16 shows an ink splay by the ink supply nozzle as shown in FIG. 15 on to the marking roller.

As shown in FIGS. 15 and 16, the tip of the ink supply nozzle 13 is made in such a manner that the cylinder tip is cut obliquely, thereby forming an elliptical ejecter 130 from which the ink is splayed along an arrow 139 on the marking roller 2, thereby filling the ink in the intaglio 22.

Figure 17:
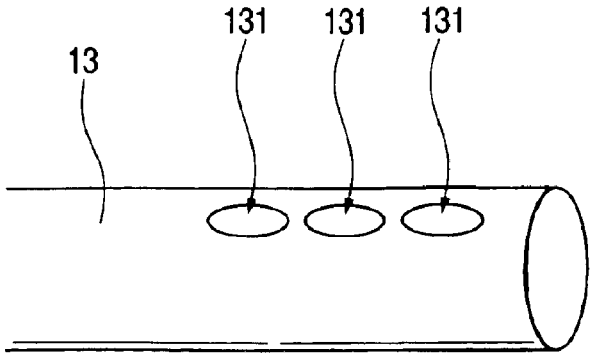
FIG. 17 is a conceptual perspective view of another ink supply nozzle with a plurality of holes of Example 5.
Figure 18:
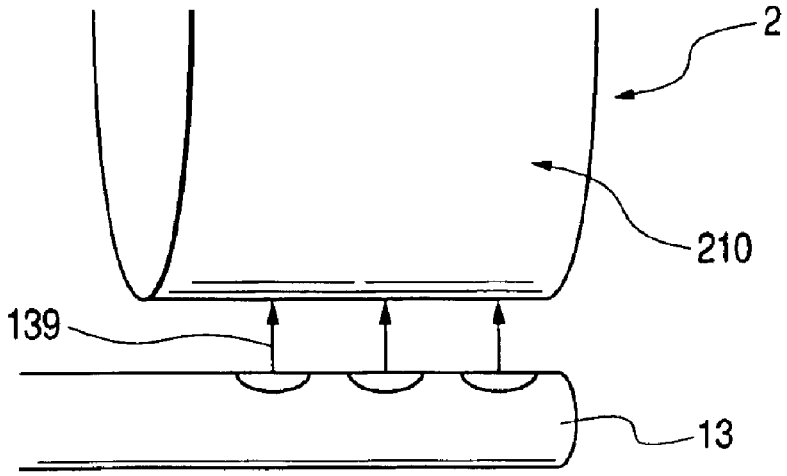
FIG. 18 shows an ink splay by the ink supply nozzle as shown in FIG. 17 on to the marking roller.

As shown in FIGS. 17 and 18, a plurality of, e.g., three nozzles 131 may alternatively be provided on the side surface of the ink supply nozzle 13. The ink is splayed from the plurality of nozzles 131 along the arrow 139 on the marking roller 2, thereby forming the ink film in the intaglio 22. Although the number of the nozzles 131 is not limited, the ink should be splayed by those nozzles on the intaglio 22 as a whole.

Figure 19:
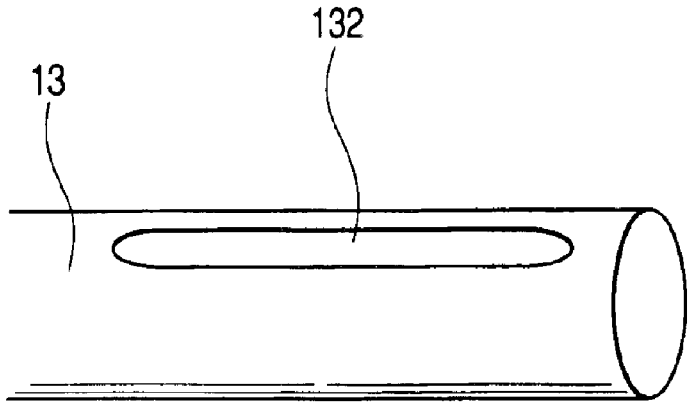
FIG. 19 is a conceptual perspective view of still another ink supply nozzle with a plurality of holes of Example 5.
Figure 20:
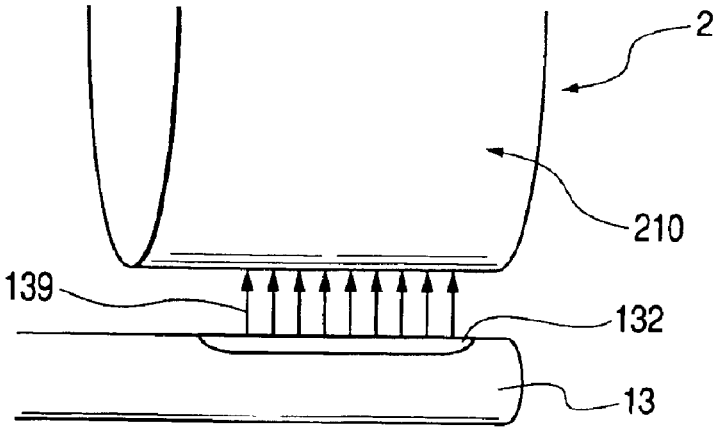
FIG. 20 shows an ink splay by the ink supply nozzle as shown in FIG. 19 on to the marking roller.

Further, as shown in FIGS. 19 and 20, a long hole 132 may alternatively be provided along the axial direction on the side surface of the cylindrical ink supply nozzle 13. The ink film is formed in the intaglio 22 by splaying the ink along the arrow 139 on the marking roller 2.

According to the printing results by using those nozzles mounted in the printing apparatus as explained in Example 1, the ink supply nozzle 13 as shown in FIGS. 19 and 20 produced the most excellent print quality.

This is because the ink supply nozzle 13 as shown in FIGS. 19 and 20 can splay the ink uniformly over the entire surface of the intaglio 22. Although the print qualities by the other kinds of the nozzles were still good, there were found such tendencies that: an uneven ink splay was occurred; and an attached old ink was apt to be dried somewhere on the marking roller 2, thereby easily contaminating the marking roller 2.

EXAMPLE 6

The print quality is affected by a printing pressure between the marking roller 2 and transfer roller 3. Here, the printing pressure (P.P.) is defined by a compression in millimeter of the transfer roller 3. The ink transfer can be controlled by the printing pressure.

If the compression of the transfer roller 2 is not sufficient enough to transfer the ink film, P.P. is defined to be negative relatively.

FIG. 26 is a table showing a relation between the print quality and P.P. of minus 0.3 mm to plus 1.8 mm. At minus 0.3 P.P., there was no transferring of the ink film from the marking roller 2 to the transfer roller 3, due to lack of elasticity of the transfer roller 3. The transfer roller of minus 0.3 P.P. could not print anything at all on the spark plug insulator 5.

When P.P. is greater than minus 0.3, the ink film was printed on the spark plug insulator 5.

Particularly, when P.P. is between 0.1 and 1.2, the print qualities were particularly excellent without little or any blur.

When P.P. is 0.0 and 1.8, some blurs or leaned printed patterns were sometimes caused, although the print qualities were excellent in general.

EXAMPLE 7

The print quality is affected by a thinner type for diluting the ink.

The ink employed in Example 7 contains 45 to 65% by weight of inorganic pigment, 20 to 40% by weight of alkyd resin, 2 to 5% by weight of glass flit (melting point, e.g., 350° C.) and 7 to 13% by weight of aromatic hydrocarbon solvent.

FIG. 27 is a table of the thinners for diluting the above-mentioned ink and controlling its viscosity.

Variously diluted inks were tested in the printing apparatus of Example 1 wherein the doctor blade 11 as shown in FIG. 11 and the ink supply nozzle as shown in FIG. 19 were employed.

FIG. 28 is a table showing a relation between the ink viscosity and print quality, wherein: Δ shows that the print quality is not degraded in spite of some spreads and blurs; ○ shows that spreads and blurs are barely recognized; and ◎ shows that the print quality is the best without little or any spread and blur.

As shown in FIG. 28, the print quality becomes the best at 20 to 70 poise.

EXAMPLE 8

Sought were inks superior both for the transfer: from the marking roller 3 to the transfer roller 3; and from the transfer roller 3 to the spark plug insulator 5.

FIG. 29 is a table showing a relation between the print quality and ink temperature. The ink was diluted by 2 wt. % quick and slow drying thinners as shown in FIG. 27. Further, the printing temperature was changed. The printing apparatus was that of Example 1 with the doctor blade 11 as shown in FIG. 11 and the ink supply nozzle 13 as shown in FIG. 19.

The undiluted ink solution was the same as that of Example 7.

As shown in FIG. 29, the print quality was Δ at 5° C., due to a slight defect in the printed pattern. The print quality was improved to be ○ at 13° C., because there were recognized only some blurs at narrow portions of the printed pattern. The print quality was ◎ at 20° C., 24° C. and 35° C., because the printed pattern does not include any blur and defect at all.

Figure 21:
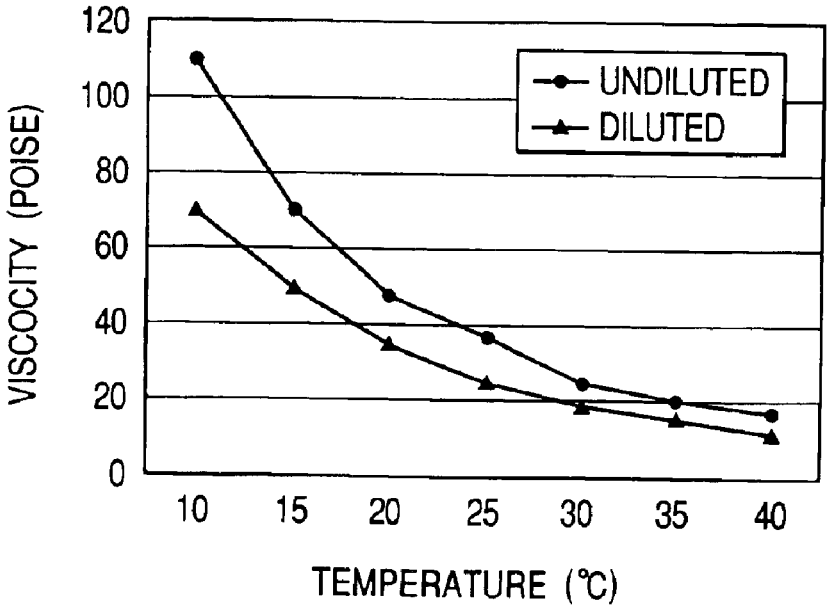
FIG. 21 is a graph showing the ink viscocity and ink temperature of Example 8.

Here, FIG. 21 is a graph showing the viscocities of the nondiluted and diluted inks (diluted by above-mentioned 2 wt. % quick drying thinner).

As shown in FIG. 21, the ink viscocity lowers, as the temperature raises.

Thus, the ink superior for the ink transfers is obtained not only by the thinner dilution, but also by controlling the printing temperature.

EXAMPLE 9

Figure 22:
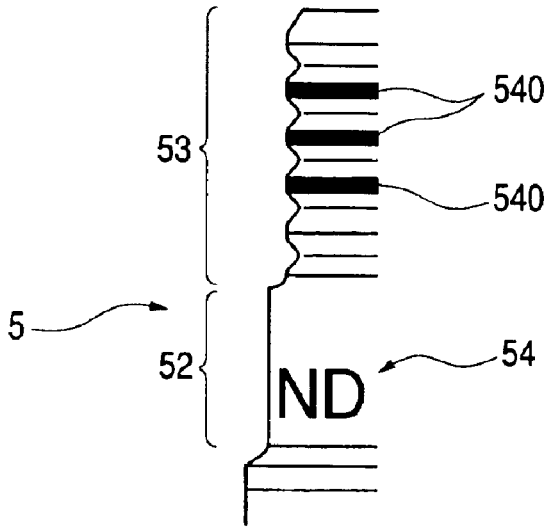
FIG. 22 shows a printed pattern of Example 9 on the spark plug insulator.
Figure 23:
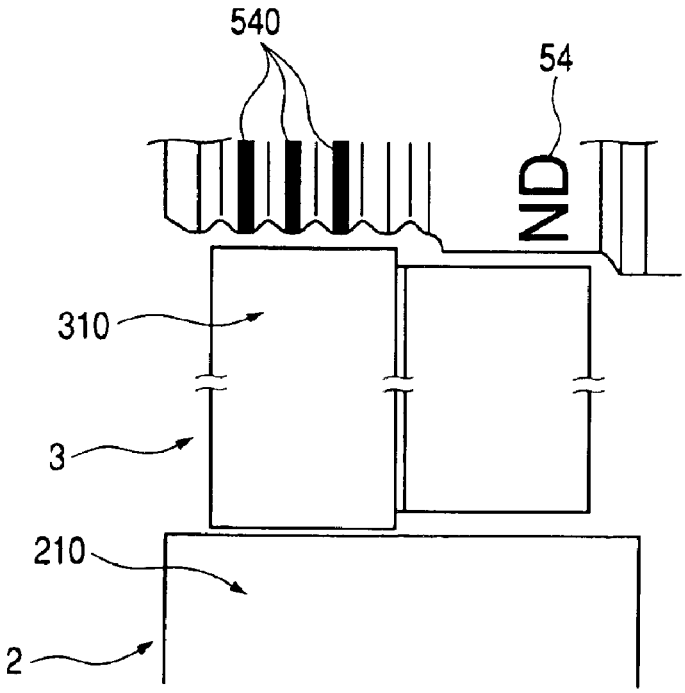
FIG. 23 shows an arrangement of Example 9 of the marking roller, stepped transfer roller and spark plug.

The printing apparatus for printing on the spark plug insulator 5 in the stepped portion 53 as well as the not-stepped extension 52 is explained, referring FIGS. 22 and 23. The exemplary pattern comprises: a letter sequence 54 on the non-stepped extension 52; and three stripes 540 on the stepped portion 53, as shown in FIG. 22.

FIG. 23 shows the transfer roller 3 for printing the pattern as shown in FIG. 22. The transfer roller 3 as shown in FIG. 23 comprises: a big portion for printing the small stepped portion 53; and a small portion for printing the bid not-stepped extension 52.

The printing pressure (P.P.) was set up in a range of 0.3 mm to 0.8 mm, thereby simultaneously transferring the ink film for the pattern 54 and ink film for the pattern 540 from the marking roller 2 to the transfer roller 3. The P.P at the big portion is greater than that at the small portion. Therefore, the step between the big portion and small portion may preferably be between 0.1 mm to 0.3 mm.

Above-set-up P.P. assured an excellent and clear print quality without a defaced transfer and excessively narrow transfer.

However, the pattern 54 may be printed at a station separate from other station for the pattern 540.

EXAMPLE 10

The marking roller 2 may be hardened on its surface.

Although its shape is the same as that of the Example 1, its surface is hardened for preventing surface damages and surface degradations of the intaglio 22 due to abrasions.

The marking roller 2 is hardened by a heat treatment (quenching treatment (QT)) and/or a hardening coating.

FIG. 30 is a table showing a relation between the print quality and marking roller hardness. The marking roller 2 is quenched to a hardness of HRC 60 to 64 and Vickers hardness of greater than 650. In FIG. 30, the materials are identified by the Japanese Industrial Standards (JIS).

The hardened marking rollers 2 as shown in FIG. 30 were hardly damaged by the blade scratching. The intaglios 22 thereof were hardly degraded, thereby maintaining the excellent print quality.

Next, an endurance of the coated marking roller 3 was tested.

Figure 24:
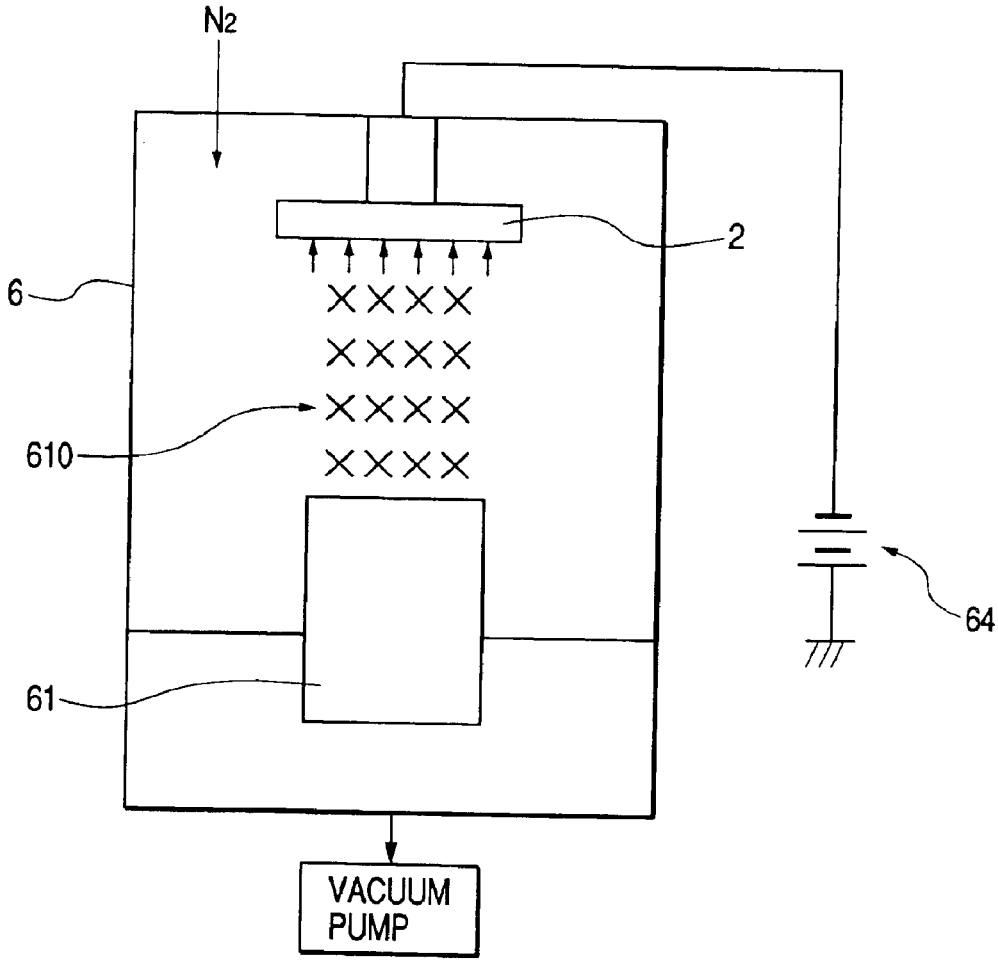
FIG. 24 shows a conceptual apparatus for TiN coating on the marking roller.
Figure 25:
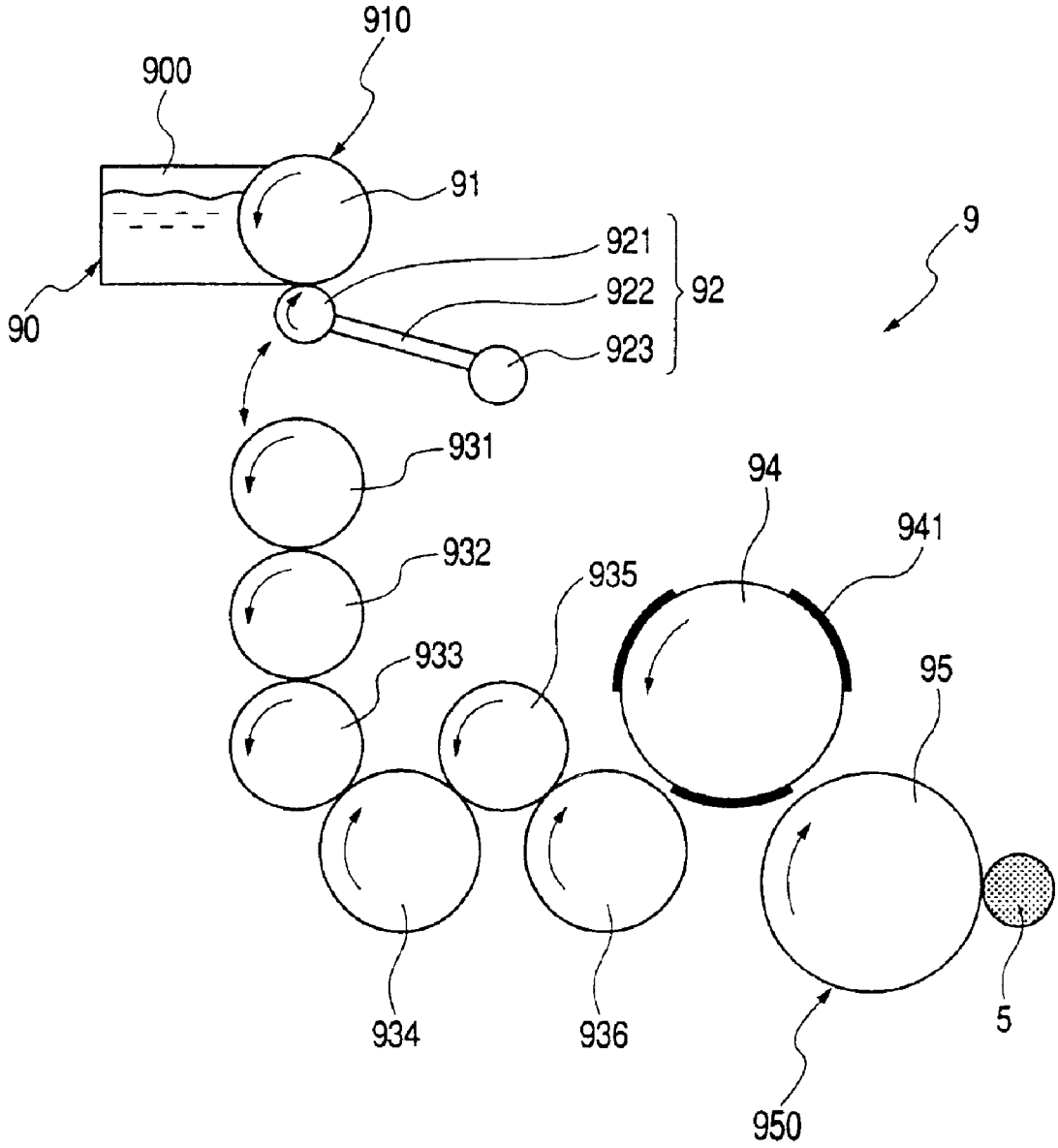
FIG. 25 PRIOR ART
FIG. 25 is an illustration of a conventional printing apparatus for printing the spark plug insulator.

As shown in FIG. 24, the whole surface of the marking roller 2, particularly the intaglio 22 was coated by, e.g., TiN by the ion plating (one of the physical vapor deposition (PVD)). The coating process as stated below is merely an example.

Concretely, a bulk Ti 61 is disposed in a vacuum chamber 6 wherein the marking roller 2 is held from upward.

The vacuum chamber 6 is evacuated and $N_2$ gas is introduced therein. Further, the vacuum chamber 6 is heated at a temperature, e.g., 200° C. to 500° C.

The voltage supply 64 supplies the marking roller 2 with a minus voltage, while Ti vapor 610 is generated from the Ti bulk 61. Thus, the Ti ions of the Ti vapor 610 are accelerated by the electric field and TiN film is deposited on the marking roller 3.

The endurance life of the TiN coated marking roller 3 was four times that of the non-coated product. However, when the TiN coated product is used over the endurance life, defects on the coating become gradually remarkable, thereby causing a possible degradation in the print quality.

What is claimed is:

1. A printing apparatus for printing a pattern on a surface of a spark plug insulator, comprising:

a marking roller for forming an ink film on an intaglio thereon;

a transfer roller for transferring said ink film which is further transferred to said spark plug insulator in order to print said pattern;

an ink supply nozzle for supplying an ink for said ink film; and a doctor blade for scratching from said marking roller ink which does not contribute to form said ink film, wherein a concave depth in said intaglio is greater than or equal to 15 $\mu$m and smaller than or equal to 20 $\mu$m, and wherein said doctor blade is disposed at an upper side of said marking roller; is movable along the tangential and normal directions of the surface of said marking roller so as to follow swelling motion of said marking roller; and is pressed against said marking roller along a direction normal to the longitudinal direction of said doctor blade.

2. The printing apparatus according to claim 1, wherein:

said marking roller is made of metal; and said transfer roller is made of resin, rubber, or resin and rubber.

3. The printing apparatus according to claim 1, wherein a degree of hardness of said doctor blade is less than that of said marking roller.

4. The printing apparatus according to claim 1, wherein said marking roller and said transfer roller are arranged such that a compression distance of said transfer roller is greater than or equal to 0.3 mm and smaller than or equal to 0.8 mm.

5. The printing apparatus according to claim 1, wherein the surface of said transfer roller is stepped in accordance with the surface of said spark plug insulator.

6. The printing apparatus according to claim 1, wherein the surface of said marking roller is hardened.

7. The printing apparatus according to claim 1, wherein the surface of said marking roller is coated by TiN.

8. A printing apparatus for printing a pattern on a surface of a spark plug insulator, comprising:

a marking roller for forming an ink film on an intaglio thereon;

a transfer roller for transferring said ink film which is further transferred to said spark plug insulator in order to print said pattern;

an ink supply nozzle for supplying an ink for said ink film; and a doctor blade for scratching from said marking roller ink which does not contribute to form said ink film, wherein a concave depth in said intaglio is greater than or equal to 15 $\mu$m and smaller than or equal to 20 $\mu$m, and wherein said doctor blade is disposed at a lower side of said marking roller and is movable along the tangential and normal directions of the surface of said marking roller so as to follow swelling motion of said marking roller.

9. The printing apparatus according to claim 8, wherein:

said marking roller is made of metal; and said transfer roller is made of resin, rubber, or resin and rubber.

10. The printing apparatus according to claim 8, wherein a degree of hardness of said doctor blade is less than that of said marking roller.

11. The printing apparatus according to claim 8, wherein said marking roller and said transfer roller are arranged such that a compression distance of said transfer roller is greater than or equal to 0.3 mm and smaller than or equal to 0.8 mm.

12. The printing apparatus according to claim 8, wherein the surface of said transfer roller is stepped in accordance with the surface of said spark plug insulator.

13. The printing apparatus according to claim 8, wherein the surface of said marking roller is hardened.

14. The printing apparatus according to claim 8, wherein the surface of said marking roller is coated with TiN.

* * * * *